United States Patent [19]

Blaser

[11] Patent Number: 4,820,251

[45] Date of Patent: Apr. 11, 1989

[54] WEB NOTCHING CONTROL APPARATUS

[75] Inventor: Giles R. Blaser, Green Bay, Wis.

[73] Assignee: Amplas, Inc., Green Bay, Wis.

[21] Appl. No.: 157,770

[22] Filed: Feb. 22, 1988

[51] Int. Cl.[4] ..... B31B 1/14; B31B 23/86

[52] U.S. Cl. ..... 493/1; 493/11; 493/22; 493/24; 493/225; 493/232; 493/237; 493/369; 493/370; 83/72; 83/372; 83/917

[58] Field of Search ..... 493/1, 11, 21, 22, 24, 493/28, 29, 35, 36, 195, 196, 225, 229, 232, 237, 342, 369, 370; 83/72, 372, 917

[56] References Cited

U.S. PATENT DOCUMENTS

| | | | |
|---|---|---|---|
| 3,319,055 | 5/1967 | Pavlenko et al. | 83/72 |
| 3,977,309 | 8/1976 | Gilbert | 493/11 |
| 4,360,354 | 11/1982 | Bishop | 493/22 |
| 4,380,943 | 4/1983 | Evans | 83/38 |
| 4,391,079 | 7/1983 | Cherney | 53/396 |
| 4,624,654 | 11/1986 | Boyd et al. | 493/194 |
| 4,664,649 | 5/1987 | Johnson et al. | 493/197 |

FOREIGN PATENT DOCUMENTS

| | | | |
|---|---|---|---|
| 2138353 | 10/1984 | United Kingdom | 493/11 |

*Primary Examiner*—Frederick R. Schmidt

*Assistant Examiner*—William E. Terrell

*Attorney, Agent, or Firm*—Andrus, Sceales, Starke & Sawall

[57] ABSTRACT

A bag forming apparatus passes a hemmed web through a rotating edge notcher and related units to form a taped hem in the web which is passed through an intermittently operated bag making machine. A web supply unit includes a web take-up unit to maintain a constant tension in the continuously moving web to the bag making machine. The web notches are phased with the bag making machine to locate the notches centrally of each bag. During starting and stopping, the web take-up unit changes the web length moving through the notching unit at normal full web speed operation and the web length variations are minimal. A programmable notch controller actuates a stepper motor to rotate the notcher. The controller responds to a control signal to form a notch. A programmable switch is coupled to the bag making machine to generate a first control signal for each bag cycle and is phased with the full web speed to locate the notch centrally of the bag. A web driven encoder is coupled to the web upstream of the notcher and generates a pulse train connected to a counter for generating a second control signal for each web length corresponding to the length between notches.

13 Claims, 3 Drawing Sheets

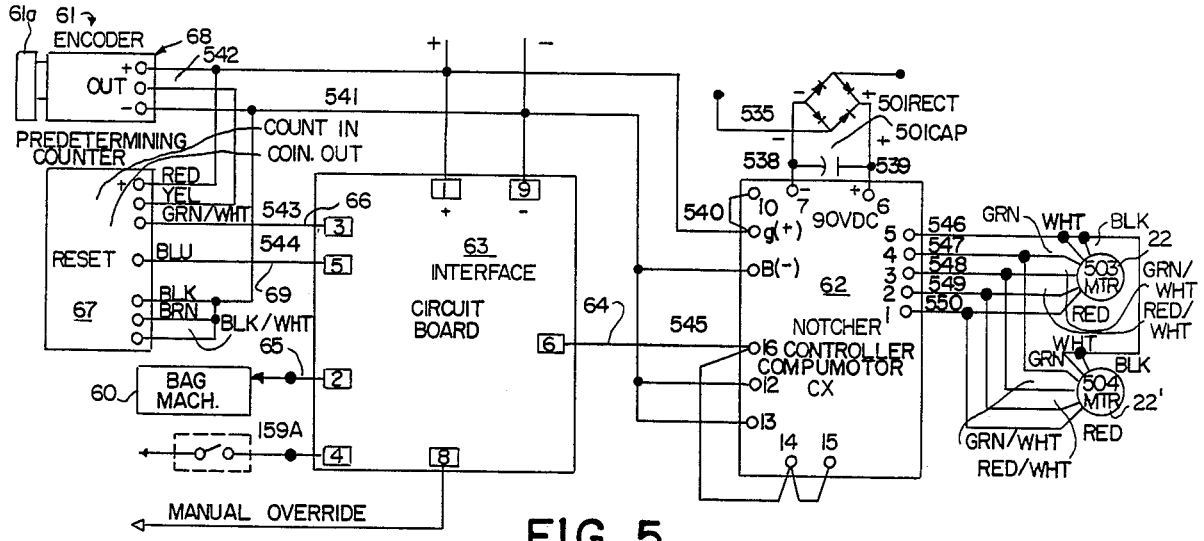
FIG. 5
FIG. 6
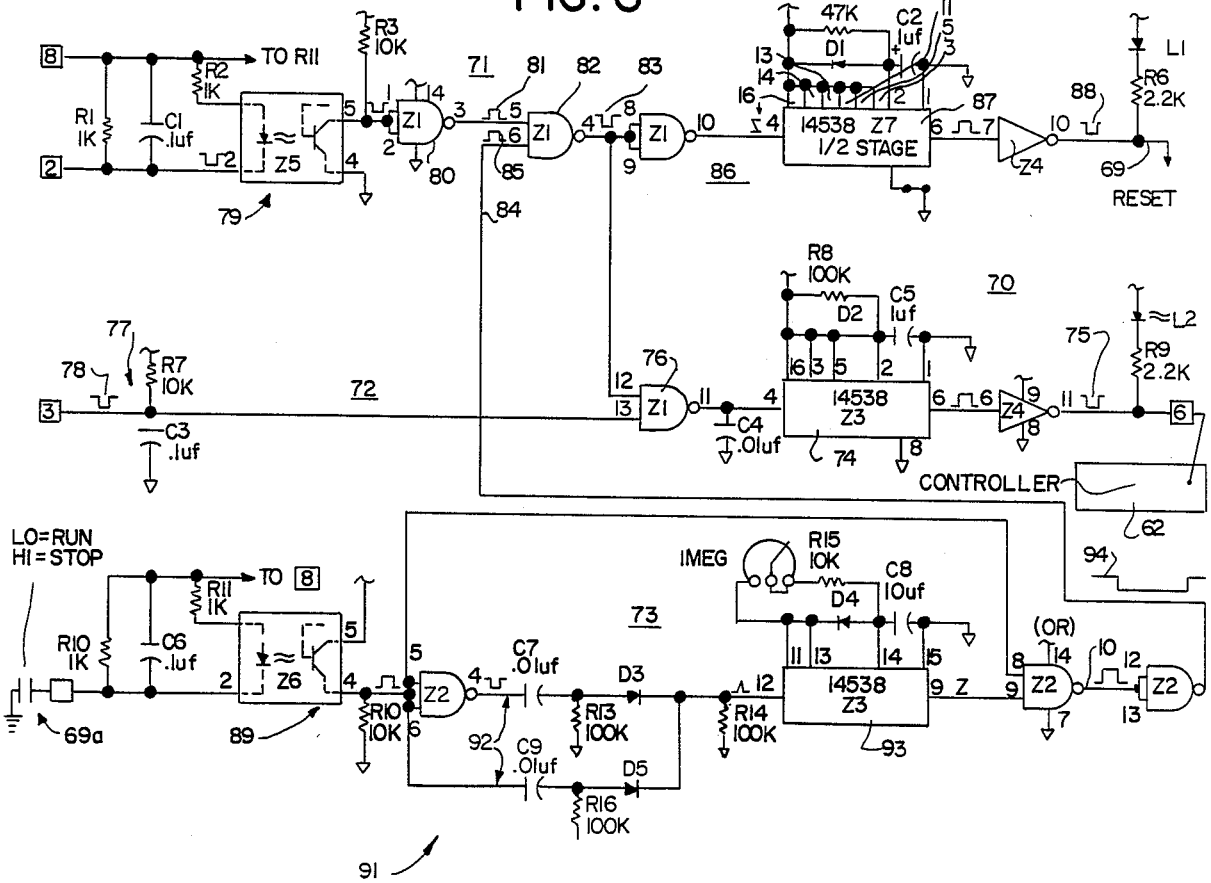

WEB NOTCHING CONTROL APPARATUS

BACKGROUND OF THE INVENTION

The present invention relates to an apparatus and method for removing an edge portion of a moving web in a web processing machine, and particularly a notch portion in a folded web edge of plastic film web for a draw tape bag.

Various products are formed from a plastic sheet material. In forming of the product, the web may be supplied from a roll of indefinite length in a continuous flow to form a series of like products. A typical example is shown in the co-pending application Ser. No. 158,418 of Robert J. Wech, entitled "Draw Tape Bag Forming Method And Apparatus", which was filed on even date herewith and is assigned to a common assignee herewith. Generally, as disclosed therein a roll of a pliable plastic web is mounted in an unwind stand. The plastic web is withdrawn as a flat continuous web and passed through a series of stations for forming a series of draw tape bags. Generally, the flat web is fed into a hem former which is adapted to fold the edges of the web inwardly to form a hem portion. The folded hem is passed through a cutting unit for removing of a peripheral edge notch defining the tape access openings in the draw tape bag. The edge notched web is fed into a tape inserter for receiving of the draw tape, followed by a heat seal unit to seal and form the hems. The hemmed plastic sheet is folded on itself, and passed through a bag forming machine which transversely bonds and severs the web to form a series of the draw tape bags. The web bags are formed with the web moving in a continuous and uninterrupted manner through the machine. Consequently, the cutting or notching apparatus must operate on the web as it moves through the notching apparatus. Various means have been suggested for removal of the edge portion of a web as it moves through a hemming apparatus. For example, U.S. Pat. No. 4,624,654 which issued Nov. 25, 1986 discloses a draw tape bag formed from a continuously moving web. The patent broadly identifies use of a simple punch unit for engaging and severing of the hem edge to form the notch or opening. The punch is actuated in intermittent time sequence through the horizontally moving web to notch the hem along longitudinally spaced locations corresponding to the central location on the top edge of the draw tape bag. A similar bag forming apparatus is disclosed in U.S. Pat. No. 4,664,649 which issued May 12, 1987 and discloses a rotary cutting device for moving through the hem portion to form the notch. The cutter includes a curved flat blade secured to one end of a rotating arm. The edge of the blade is formed as a cutter edge. A motor is connected through a brake and clutch unit to rotate the arm. The motor runs continuously at full operating speed. The brake holds the rotating arm and cutter in a predetermined spaced relation to the moving hem. Whenever a notch is to be formed, the brake is disengaged and clutch is engaged coupling the head to the full speed operating motor. This provides a sudden load on the motor which then serves to accelerate the drive mechanism including the arm and accelerates the arm to move from the standby position through the cutting position. After forming the notch, the clutch is de-energized and the brake is energized to stop and hold the cutter in standby for the next cycle. The assembly including the clutch and brake mechanism is housed in a protective structure adjustable with respect to the edge location. The assembly is difficult to mount and adjust for optimum cutting. Further, the engaging and disengaging of the cutter mechanism with the motor through the brake and clutch mechanism and particularly with the motor at the full speed creates maximum stress on the various members and mechanisms. Such a system will generally require maximum maintenance and reduce the overall anticipated operating life of the mechanism.

The problem is even more significant in a flat web processing system wherein web hems are separately formed and processed, requiring duplicate notchers in forming of a draw tape bag.

Although there are operative devices for edge notching of a web such as the hem of a draw tape plastic bag, there is a need for a more efficient and effective cutting apparatus for forming notches in a continuously moving web and particularly in an edge folded plastic web such as used in forming of draw tape bags.

SUMMARY OF THE PRESENT INVENTION

The present invention is particularly directed to an edge notching or cutting apparatus and method which avoids the disadvantages and difficulties associated with prior art devices and provides a compact, direct drive system for producing a clean cut in the edge of a rapidly moving web in a high speed web processing machine. Generally, in accordance with the present invention, a rotating cutter head is rotatably mounted within a suitable support. An intermittently activated indexing motor unit such as a servo motor, a stepper motor or the like. This motor has its shaft coupled by a drive to the cutter head and operates to rotate the cutter through a predetermined angle in response to pulsed energization of the motor. The invention may include a servo motor unit depending the cost. With present day technology, a stepper motor is preferred and the invention is described with reference to such a motor for simplicity and clarity of explanation. Stepper motors specifically provide precise rotation in response to a pulsed energization of the motor. The angular displacement per pulse energization is precisely repeated for each successive pulse. This provides a positive drive with precise, fixed and repeatable rotation of the cutter head. A stepper motor controller, of a programmable variety is preferably provided to energize the stepping motor, with programmed control of the cutter head torque and velocity, the direction of rotation and the rotational distance. Such controllers can readily provide both acceleration and deceleration control to a maximum velocity at the time of web cutting, with a smooth starting and stopping motion thereby minimizing loading within the drive mechanism and the cutting head proper while producing the necessary high velocity movement through the web edge.

Further, the notching unit must be operated in appropriate time spaced sequence with respect to the movement of the web moving through the apparatus to locate the notches centrally of the bag. This requires that the cutting blade move through the web in a particular phased relationship with respect to the movement of the bag through the hem forming unit and the bag making machine. During normal full web speed operation, the notching apparatus can be operated directly in timed relation to the drive means for moving the web through the line. A suitable signal source can be coupled to the web drive means for generating appropriately time spaced signals to form the notch during each bag making cycle for proper central location with respect to the bag to be formed from that portion of the web. The signal source preferably includes an adjustable control for setting the control signal to accommodate different web speeds.

The web is maintained under a constant tension condition through an accumulator unit. Under full web speed operation, variation in the web tension is compensated for by slight movement within the accumulator unit. Generally the variation is so slight that the length of web moving through the notching unit during each bag making cycle does not vary significantly. Consequently the notching unit can be operated directly off the web drive without any noticeable deviation of the notch from the desired central location of the bag.

During start up and during shut down of the apparatus greater variations in the web movement are normally created. The accumulator takes up and plays out the web in appropriate relationship to such variations to maintain the tension condition and permits continued formation of bags during the start up and finish or shut down of the apparatus. This is desirable to minimize waste of material. However, it will be recognized that with a significant variation in the take up of the web, the length of web moving through the notching unit during a bag making cycle will vary significantly. If the notching unit is still driven off the bag making cycle, the notch in the bag will not be maintained. The notch location tolerance is readily maintained under full speed operation but generally cannot be met in start up and shut down.

In accordance with the present invention, a control circuit is, provided for automatically providing a modified control responsive directly to the length of web movement through the notching unit during start up and shut down. The control circuit generally includes a main signal source coupled to the bag making machine for actuating the notching unit during full web speed operation and a second signal source responsive to actual length of web movement for each bag making cycle during start up and shut down of the apparatus. An interlocking logic control provides for automatically establishing the web length control during start up and shut down and web drive control between such selected periods of web length movement variation.

In accordance with this aspect of a preferred embodiment, a suitable signal generator is coupled to a machine shaft and generates a start pulse signal once during each bag making machine cycle. This provides a necessary time spaced signal for energizing the cutting unit during normal full web speed machine operation. The web length signal unit includes an encoder having a rotating input roll coupled to the web. In the illustrated embodiment of the invention the roll wheel is coupled to the web at the guide roll for turning of the web from the hem forming unit into the notching unit. The encoder may be a conventional encoder establishing a fixed number of pulses per revolution, and providing a direct pulse train accurately related to the length of the web moving over the guide roll and therefore through the notching unit. The output of the encoder is coupled to a resettable counter. The counter is set corresponding to the count of pulses corresponding to the web length between the centered notches. At a coincidence count a second control signal is generated for operating the notching unit. During normal full speed web movement the web driven or web drive signal source establishes a an actuating signal prior to a coincidence signal in the counter. The signal from this source is operable to actuate the notcher and simultaneously reset the counter thereby such that the notcher is operated in appropriate time based sequence from the signal source. During start up and shut down cycles a timer unit is activated and coupled to operatively disable the output of the signal generator for a appropriate period. During this period therefore, the counter is not reset and coincidence signals will be generated in accordance with the actual length of the web moved through the machine and particularly through the notching apparatus. The timer is set for an appropriate period to insure that the start up period is sufficiently long that the web is moving at its normal full speed at the end of the timing period. Similarly the shut down time period will be selected to insure complete shut down of the apparatus with maintained proper operation of the notching apparatus.

The notching apparatus of the present invention thus permits the accurate location of an opening or notch in a rapidly moving web. The cutting apparatus is readily constructed using present day technology and components including a suitable programmable controller.

BRIEF DESCRIPTION OF THE DRAWINGS

The drawings furnished herewith illustrate the best mode presently contemplated for carrying out the invention.

In the drawings:

FIG. 1 is a simplified side elevational view of a portion of a draw tape bag forming machine incorporating an of the present invention;

FIGS. 2 and 2*a* a plan and side view of a bag formed on the embodiment of the invention illustrated in FIG. 1;

FIG. 5 is a block diagram of a controller unit for control notching apparatus; and FIG. 6 is a schematic circuit illustration of an interface circuit board shown in FIG. 5.

DESCRIPTION OF THE ILLUSTRATED EMBODIMENT

Figures 1, 2A, 2B:
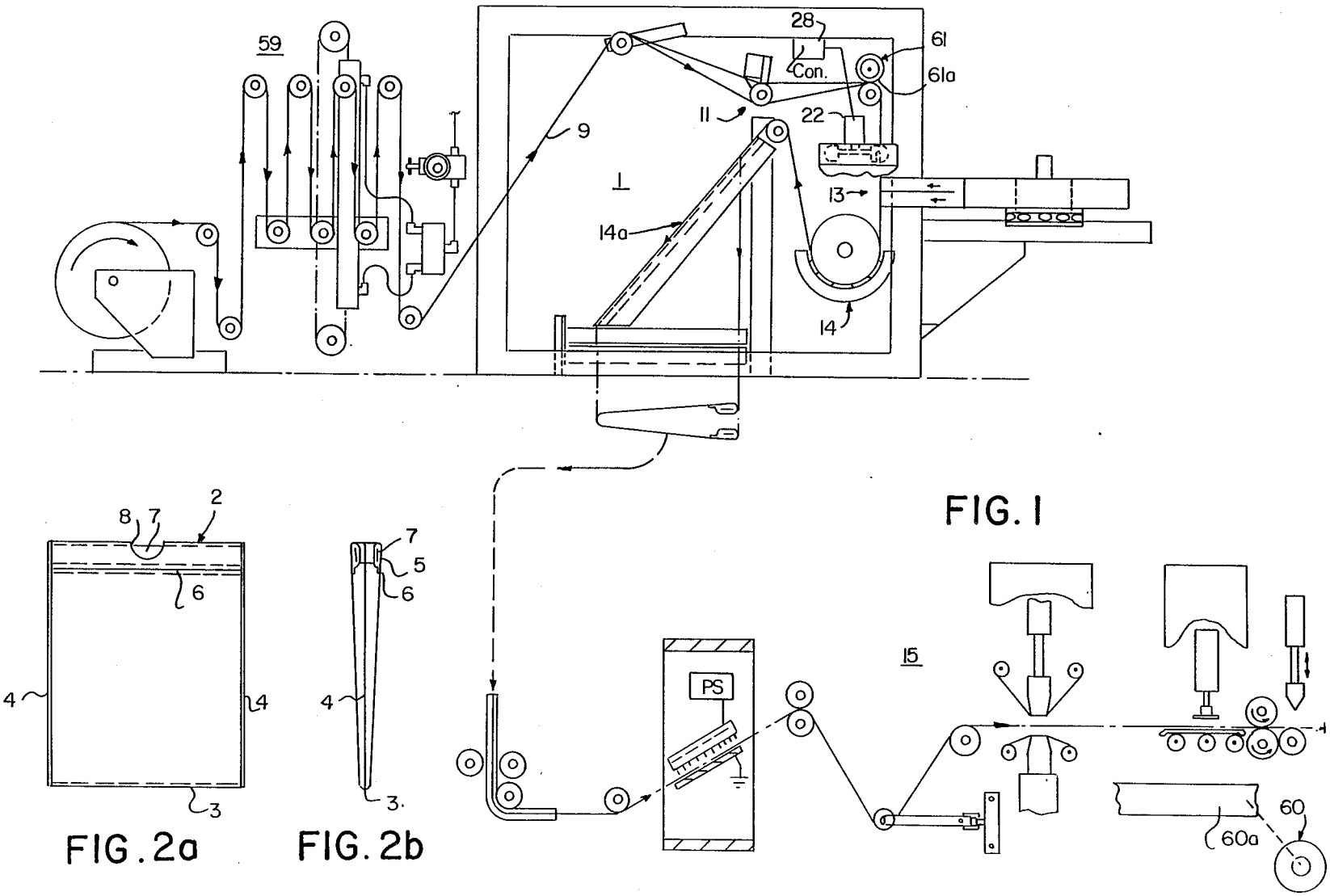

Referring to the drawings and particularly to FIG. 1, a hem forming unit 1 of a draw tape bag forming apparatus is shown for forming a draw tape bag 2 as shown in FIGS. 2 and 2*a*. The bag 2 is formed of a single integral plastic web and includes opposite similar plastic side walls having an integral bottom edge 3. The side edges of the bag are formed by heat sealed seams 4. The top or open end of the bag is formed with a hem 5 integral with each side wall. The inner wall of the hem 5 is formed by folding the side wall inwardly and forming the hem walls by a heat sealed seam 6 to define an internal tubular channel portion. Similar draw tapes 7 are located in each side hem 5 with the opposite ends of the tapes sealed to the side edges of the bag. Each hem has an opening 8 generally centrally of the side wall and centrally between the edge seams 4. Pulling outwardly on the draw tapes 7 causes the open end of the bag 2 to collapse and close.

In the forming of the bag 2, a flat web 9 is continuously fed through the hem forming apparatus 1, as shown in FIG. 1. Generally, in forming of the bag, the opposite edges of the web are folded on themselves to form the hem walls. The hem formed web is then passed through a cutting unit 10 for forming of the notches or openings 8 in the hems 5.

A particularly satisfactory method of manufacture of a draws tape bag is disclosed in the above co-pending application of R. Wech. As more fully disclosed in that application, the draw tape bag 2 is formed from flat web 9 which is sequentially passed through a hem folding station 11, a notching station 12 including cutting unit 10, a tape inserting station 13 and a hem sealing station 14. The hemmed bag is folded on the center line to align the hems at a folding station 14*a* and the folded web is passed through a bag making machine 15 for sealing and severing unit to form the side edge seams 4 at appropriate spaced transverse lines to complete the bags. The hem folding and sealing apparatus as well as units for forming of the bag may be of any desired construction, and is preferably formed as disclosed in the previously identified co-pending application by Robert J. Wech. The edge notching unit 10 severs and removes a portion of the folded hem 5 to form the tape openings 8, with the hem folded web moving in a continuous and uninterrupted path through the notching unit 10. Further description of the other units or portions of the machine are not therefore set forth herein other than as necessary to clearly describe the illustrated embodiment of the present invention.

Referring particularly to FIGS. 3–6, the notching or cutter unit 10 of this invention is formed as a separate module mounted to the main frame 16 of the hem forming machine. Two of the notching units 10 are provided and mounted to the opposite sides of the machine in alignment with the respective folded hems from the hem former unit 11. Each module is identically constructed and consequently a single module will be described in detail.

Generally, the cutter unit 10 includes a rotating cutter head 17 mounted within a suitable protective cutter enclosure 18. The enclosure 18 is adjustably mounted to a cross beam 16 on the main machine frame for selective lateral adjustment with respect to the web 9. The cutter enclosure includes a narrow opening 19 aligned with and telescoped over the hemmed edge 20 of the web 9, with the hemmed edge passing therethrough. A pair of guide blocks or plates 21 are mounted in the enclosure 18 to smoothly support the hemmed edge 20 of the web 9 as it moves through the cutter unit 10. In accordance with this invention, a stepper motor 22 is secured to the top wall of the enclosure 18. The stepper motor 22 has its shaft 22*a* projecting downwardly through the enclosure into alignment with and defines the rotating axis of the head 17. The head 17 includes an arm 23 releasably clamped to the shaft 22*a* for direct drive and rotation of the arm about the vertical axis. A curved cutter blade 24 is supported by the arm 23. The cutter blade 24 is a generally a band-type blade having a curved configuration corresponding to the curved configuration of notch 8 shown in the drawings. The cutter blade 24 is mounted with a vertically oriented cutting edge 25 such that rotation of the cutter results in passage through the path of hem 20 for removal of the material 26 and forming of the desired notch 8 in the edge of the hem.

The stepper motor 22 provides for precise and rapid acceleration of the cutter from a rest position to the cutting position and generates a smooth, reliable removal of the notch material 26 without disruption of the notch edge or the adjacent web material.

In the illustrated embodiment of the invention, the guide plates 21 are formed with a complementing notch 27 aligned with the blade 24 in the cutting position. The guide notch 27 is slightly larger and of the same configuration of the cutting blade 24 such that the web material 26 is severed with a shear cutting action.

In the illustrated embodiment of the invention, the head and cutter is rotated 360 degrees for each notch formation and cutter blade 24 starts 180 degrees from the guide plates 21. At the appropriate time, the stepper motor 22 is energized and rapidly, smoothly accelerates the head 17 to produce maximum velocity as the cutter blade 24 moves through notch 27 in the guide plates 21. The motor 22 similarly, smoothly decelerates after passing the guide plates and returns to the home or standby position.

The pulsing of the motor is provided with suitable time control. A preferred embodiment of timing control unit 28 is shown in FIGS. 5 and 6 provided the location of opening 8 and the intermittent movement of the cutting blade 24. Programming of the stepper motor acceleration and deceleration can be readily provided through any suitable hard wired or computer based logic control system. With modern day technology, microprocessor acceleration control systems are readily provided by those skilled in the art.

The stepper motor is thus connected to a suitable control unit 28 which is actuated in accordance with the reference speed of the web 9 and the intermittent bag making cycles of the machine 15 for optimum cutting of the openings 8.

The stepper motor 22 is connected to a DC power supply through the drive and logic control circuitry. In accordance with well known phenomena each energization of the stepping motor results in a predetermined angular movement of the stepping motor. In the present invention as described, each step results in a 360 degree rotation of the head. The stepping motor may be energized with a series of steps during each rotation, and provide rapid acceleration of the output shaft and cutter head 17 without creating shock loading. Thus, the stepping motor may be actuated with a plurality of stepped levels to enhance its speed and power characteristics during the rotation of the cutter.

In operation, the stepper motor 22 and enclosure 18 is appropriately mounted as a unit to the cross beam 16 with the web hem 20 passing through the guide plates. The cutter blade 24 is located so that a precise notch or opening 8 is removed from the outer portion of the hem, such as approximately 50% of the depth of the hem. Upon operating of the draw tape bag machine, the motor control unit 28 is energized. The head 17 rotates from the home position through 360 degrees in time spaced relation to provide notches spaced from each other in accordance with the spacing of the notches in the sequentially formed bags 2. The pulse energization for the motor 22 is activated somewhat prior to the alignment of the web notching portion with the guide plate 21 to permit controlled rapid acceleration of the cutter head 17 to the cutting speed with the web hem 20 precisely in alignment with the cutting guide notch 27. The blade 24 then moves through the web at a very high rate of speed and severs the web with the shear cut creating a smooth, clean cut notch edge. The severed material or slug 26 is carried by the blade 24 outwardly into the enclosure 18 where it drops downwardly under the force of gravity. The bottom portion of the enclosure 18 defines a discharge outlet for removal of the notch slug 26.

Figure 3:
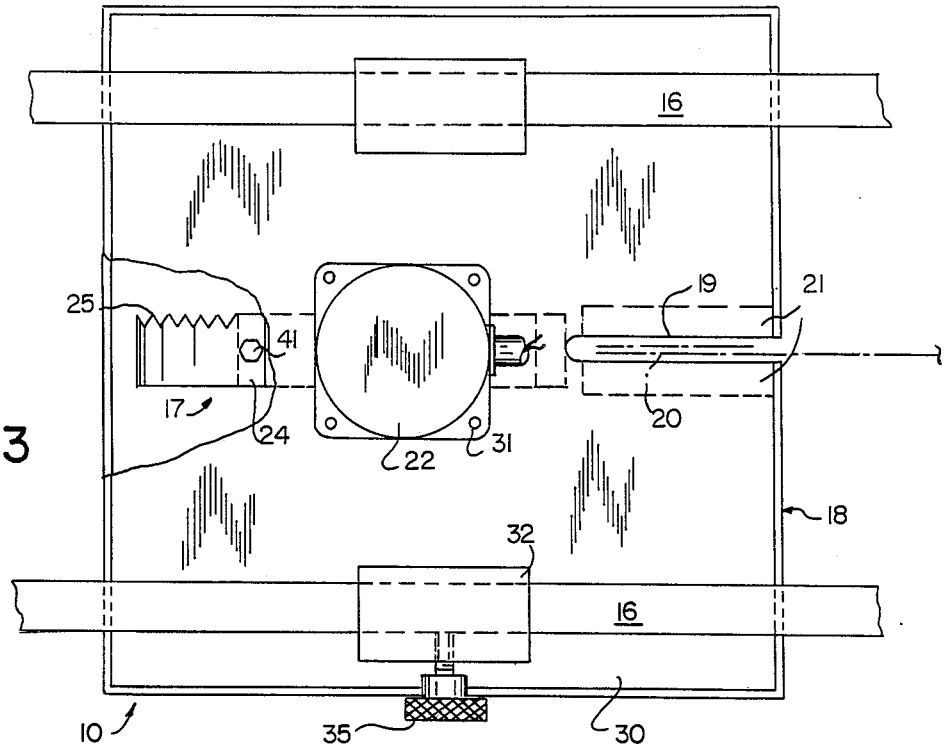
FIG. 3 is an enlarged plan view of a web notching embodiment of the invention illustrated in FIG. 1.
Figure 4:
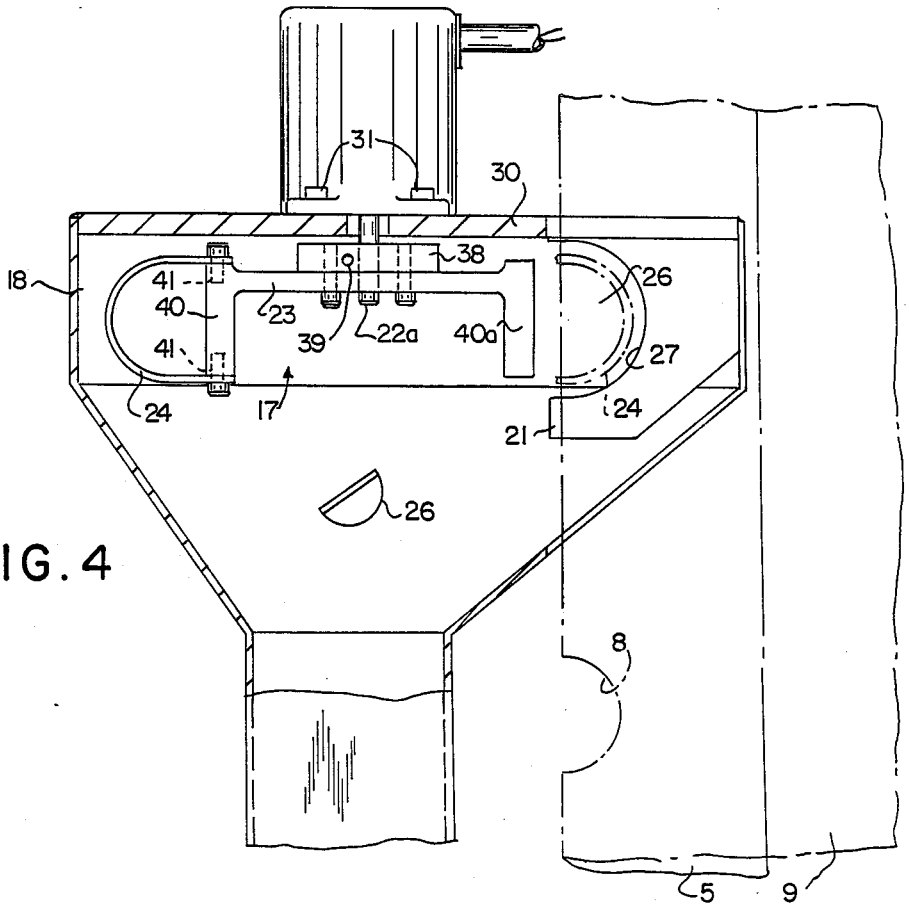
FIG. 4 is a side view of FIG. 3.

In the illustrated embodiment of the invention as shown in FIGS. 2–4, the motor 22 is mounted to a motor base plate 30 as by a plurality of bolt members 31. The plate 30 is a square plate of a width greater than the length of rotating head and the web guide plates. The base plate 30 forms the top wall of the enclosure 18. Guide slides 32 are secured to the exterior of the plate 30 to the opposite side of the stepper motor. The guide blocks are U-shaped and are slidably mounted on machine beams 16 to slidably support the motor 22 and cutter 17 for positioning relative to the hem 20. A retaining plate 33 closes the U-shaped guide slides. A threaded lock and knob unit 35 is provided in at least one of the guide slides 32 for locking of the cutter to the machine beams 16. This permits accurate location of the enclosure with respect to the continuously moving web 9.

The enclosure includes side walls secured to the edge of the base plate 30. The enclosure 18 depends downwardly therefrom to define a square enclosure about the cutting head 17. A tapered or funnel shaped extension 37 is secured to the side walls defining a chute for directing of the severed material or slugs 26 from the enclosure. The chute carries the slugs 26 from the enclosure to a suitable disposal devices, such as a collection bag, not shown.

The enclosure adjacent the web 9 is provided with the slot 19 extending vertically downwardly through the enclosure generally in alignment with the center line of the stepper motor 22. The web guide plates 21 are secured to the motor base 30 within the housing 18 and located to define a corresponding vertical slot for accommodating of the movement of the web 9 through the slotted enclosure 18. The web guide plates 21 are shown stradling the web 9 so as to insure proper web positioning during the cutting and to establish a shear cut with the rotating blade 24. The inner face of the guide plates are provided with identical U-shaped notches 27 slightly larger than the webbed notch and in alignment with the cutter, as shown in phantom in FIGS. 4 and 5.

The shaft 22*a* of the stepper motor 22 projects downwardly into the housing. The cutter head 17 and particularly arm 23 is releasably fixed to the shaft 22*a* to provide a rigid, firm interconnection therebetween. In the illustrated embodiment of the invention, the cutter head 17 includes the cutter arm extending radially of the shaft 22*a*. A shaft clamp unit 38 is bolted to the arm 23 and secures the arm to the shaft with a firm affective rigid interconnection therebetween. The clamp unit 38 can be a simple C-clamp having a clamping bolt 39 for tightening of the clamp about the shaft, and providing the direct connection. The motor connection in the present invention includes a direct drive such as illustrated. Other direct drives such as a timing belt, a chain, gears or the like may be used.

The cutter arm 23 is a rigid arm member projecting diametrically and radially from the shaft. The opposite ends of the arm terminate in depending integral cross bars 40 and 40*a*. The notch cutter blade 24 is shown as a band-type element shaped into a U-shaped configuration corresponding to the notch 8 to be formed in the hem 5. The opposite ends of the blade 24 are firmly secured abutting the opposite ends of the cross bar 40 on one end of the cutter arm 23, as by clamping bolts 41. The cutting blade projects outwardly with the outer curved portion located adjacent the periphery of the head unit. The blade 24 is thus curved in a vertical plane in the illustrated embodiment and includes the sharp knife edge 25 formed on the lead edge. The length of the shaft and cutter blade is accurately located with respect to the notch 27 in the guide plates, such that the rotation of the head results in the blade, and particularly the cutting edge, moving through the blade plate notch in close spaced relation thereto to form the shear cutting action.

The opposite end of the cutter arm projects outwardly with the cross bar 40*a* providing a counterweight to provide a balanced load on the motor shaft 22*a*.

In use, the cutter unit 10 is mounted on the machine spacer or beams 16 to accurately locate the cutter 24 and the guide plates 21 with respect to the hem edge 20 of the web 9, and is locked in placed. The stepper motor 22 is coupled to the appropriate DC power supply by the drive/logic control unit 28 for timed operation with the continuous and uninterrupted movement of the web 9 through the machine including the hem cutter unit 10. The stepper motor 22 is actuated in time spaced cycles to directly rotate the cutter blade 24 one complete revolution for each cutting cycle. The dwell or home position is located 180 degrees from the web path and plates 21. At the appropriate programmed time, the stepper motor 22 is energized to accelerate the arm and cutter blade 24 from zero velocity to a maximum velocity as the cutting edge 25 moves into cutting engagement with the moving web 9 and notch 27 of plates 21. The 180 degrees allows ample time for the stepper motor to accelerate to the maximum velocity in a smooth controlled acceleration with minimal shock forces. The knife edge 25 passes through the web hem 20 at the precise time to accurately form the notch 8 essentially on the center of the draw strap bag 2.

Immediately upon moving through the web, the drive/logic control unit 28 establishes the smooth deceleration of the cutter head 17 to the reference position. The slug 26 drops out of the cutter 24 into the chute 37 for delivery to a receiving unit, not shown. The notched plastic web 9 continues through the machine to form bag 2.

During shut down and start up of the apparatus, an accumulator unit 59 forming part of the web supply to the hem forming unit 1 may move significantly to maintain the proper web tension. This will result in a variation in the length of web 9 moved through the notching unit during the bag making cycle. The controller 28 is specially constructed to respond to different signals during the normal full web speed operation and during the start up and shut down.

In the illustrated embodiment of the invention, notching unit 10 is actuated in a timed sequence during normal full web speed movement through the apparatus. During the start up and shut down of the apparatus, the length of the web 9 actually moved through the apparatus is monitored and the notches formed in accordance with the actual lengths of web which permits continued appropriate forming of the notches centrally located in the final bags.

More particularly, a bag machine signal generator unit 60 is coupled to the bag making machine and provides a cutter initiating signal in accordance with each cycle of the bag making machine. The unit 60 can be of any suitable construction and is preferably a programmable switch including a rotating input in a one-to-one connection to a main drive shaft 60*a* of the bag making machine 15 which permits direct phase adjustment of the timing of the cutter initiating signal in relationship to the web speed. This permits a direct and rapid set up and adjustment of the system for different web speeds and the like. Various programmable switch units are available in the marketplace. A satisfactory switch unit is a model M1000PLS unit manufactured and sold by Autotech Corporation of Carol Stream, Illinois. Such devices are readily understood and no further description thereof is given herein.

The generator unit 60 provides an appropriate signal for actuating the control unit 28 under normal full web speed operation.

A web driven encoder 61 is coupled to the web 1 and includes a driven wheel 61*a* coupled to the web and driven thereby. The wheel 61*a* is shown in FIG. 1 is coupled to the web 9 at a guide roll for turning of the web 9 from the hem forming unit 11, into the notching unit 10. The encoder 61 provides a pulse output with a constant number of output pulses per each complete revolution of the rotating wheel 61*a*. The number of pulses correspond to the length of web moving into the notching unit 10 and provides for generation of a control signal to notching unit 10 when the precise and desired length of web has moved through the notching unit and another notch is to be formed.

The output of the generator unit 60 and the encoder 61 are coupled to and connected to the control unit 28 for the notching unit 11 and provide alternate controls during the appropriate periods. The encoder unit 61 is operable during selected periods when significant variations occur in the web length passing through the notcher unit for each bag cycle, such as during starting and stopping of the hem forming unit 1 and the bag making machine 15.

A satisfactory circuit of the control unit 28 is illustrated in FIGS. 5 and 6.

FIG. 9 is a block diagram of the control unit. The power supply connections are standard and identified by conventional plus and minus polarity symbols. In addition, the circuit may include various such a manual override to shut down the notcher and permit operation of the machine without operation of the notching unit and the like are provided. These and other desired controls can be provided in accordance with any desired design and illustration description of such elements are set forth herein.

The control unit includes a purchased controller 62 having its output connected to the stepper motors 22 and 22'. The controller is any suitable controller which will provide a predetermined programmed acceleration and deceleration of the stepper motors and coupled loads in response to an input triggering signal. A satisfactory controller is a CX model available from Compumotor of California. The controller 62 is connected to suitable logic and power D.C. power supplies as illustrated. An interface circuit board 63 has an output line 64 connected to the initiating input of the illustrated controller. The interface board 63 is connected to the encoder 61 and the machine drive signal generator unit 60 to provide appropriate logic control of the notching unit in the various time periods.

The interface board 63 includes an input 65 connected to the output of the programmable switch unit 60. Under normal full web speed, the signal is operative to continuously provide timed spaced signals to line 64 for appropriate operation of motors 22 and 22'. A signal line 66 is connected to a second input of the interface board 63. The signal line 66 is connected to the output of a counter 67 the input of which is connected to the pulse output unit 68 of the encoder 61. If the counter 67 counts a number of pulses preset for actuating of the notching unit, a signal appears at the coincident output line 66 to the interface board 63, which transmits a control signal via the output line 64 to correspondingly actuate motors 22 and 22' and connected cutting heads. The interface circuit board 63 includes a reset line 69 connected to the reset input of the counter 67 for resetting of the counter and initiating a new counting cycle. The reset line 69 operates during the period of full web speed operation to reset the counter 67 before a coincidence count is established. During start up and shutdown of the unit, the interface circuit 63 generates an appropriate timed signal in response to actuation of the start or stop operation, as by operation of a start/stop switch 69*a* to disable the input at line 65 for the period necessary to fully start and stop the apparatus.

Illustration of an interface circuit is shown in FIG. 10.

Referring particularly to FIG. 10, the interface circuit includes a notcher signal circuit 70 having a pair of inputs connected respectively to a main machine drive signal circuit 71 and a counter signal circuit 72. A timing signal circuit 73 has its output connected to the circuit of the main machine drive signal circuit 71 o provide a timed interlock during the machine start up and shut down in response to the initial starting and stopping of the apparatus.

The notcher signal circuit 70 includes a one shot unit 74 of a known and conventional construction to generate a negative logic signal 75 in response to receipt of a notch initiating signal. The signal 75 is coupled to and actuates the controller 62 to initiate a cutting cycle. The circuits 71 and 72 are coupled to the input of the one shot unit 74 by a logic gate shown as a NAND gate 76. A negative signal at either one of the inputs of the two input gate 76 will generate an appropriate initiating pulse 75 to controller 62.

The encoder signal circuit 72 includes an essentially direct connection to the output of the coincident output 66 from the counter 67. In the illustrated circuit, a noise supression circuit 77 is provided to provide an appropriate signal for actuating of the logic gate 76. The output of the counter 61 is a low logic signal 78 which as previously noted is transmitted by the NAND gate 76 for triggering the one shot unit 74.

The main bag machine signal circuit 71 includes an isolating input circuit 79 connected to the output of the signal generator unit 60. A logic signal NAND gate 80 is connected to receive the input signal from the circuit 79 and provide a high or a positive going signal 81. A combining gate 82 shown as a NAND gate has two inputs. A positive or high signal at each input generates a negative going signal 83 at the output. The output signal 83 is coupled to the one input of the NAND gate 76 which as previously noted responds to a negative going pulse signal to actuate the one shot 74 for operating the notching controller 62.

A timed interlock line 84 connects the second input of the NAND gate 82 to the timer circuit 73. At normal full web speed operating conditions, the timer 73 is in a stand by condition and generates a positive pulse signal 85 to the NAND gate 82 thereby turning the NAND gate on for transmitting of the signal 81 in the machine drive signal circuit 71. Thus under full web speed operation the signals are continually transmitted to gate 76 to continue the notching operation.

The signal 83 is simultaneously supplied to a reset signal logic circuit 86. The negative going pulse 83 is inverted and actuates a one shot unit 87 to generate a negative going signal 88 at the output line 69 of the interface circuit 63. The signal is transmitted to the counter and resets the counter. Thus each notch operating signal 81 simultaneously resets the counter to restart the counting cycle. The signal will be generated prior to creating of a coincidence count and forming of a signal at line 66.

Timing circuit 83 is shown as a well known electronic timing circuit. An opto-isolator 89 has its input connected to the machine control switch 69*a*. The unchange in the switch conditions generates a pulse signal to the electronic timing circuit 91, shown as a known one-shot circuit. The circuit includes a pair of input lines 92 connected to the opto-isolator 89, and lines 92 respectively provide actuation of a one-shot 93 to generate a negative going or low pulse signal 94 at the line 84 to the gate 82. The timing circuit 91 is actuated at the start-up or starting of the apparatus and is similarly actuated at the initiation of the shut-down of stopping of the apparatus. The output of the timing circuit is a negative going pulse 94 of a fixed predetermined length corresponding to the necessary period to insure a full start up of the apparatus and full shut down of the apparatus.

In summary, referring to FIGS. 5 and 6 when the circuit is first started, switch 69*a* is closed and creates a pulse signal to the timing circuit 91 which in turn will generate the lock out pulse 94. The signal 94 at gate 82 will effectively disable the gate and prevent transmission of the generator related pulse signal 81.

The movement of the web 9 actuates the encoder 61 to generate a pulse train to the counter 67. The counter reach the preset setting corresponding to the desired length, of web for proper location of the notch. At such coincidence, the counter establishes signal 78 which is coupled through the NAND gate 76 to generate a signal to the controller 62 for initiating a cutting cycle. The counter resets automatically in response to creating of the pulse 78 and initiates a new count cycle. The encoder 61 and counter 67 will thus repetitively provide pulses 78 to actuate the notching unit 10 in accordance with the length of the web passing through the notching unit 10 between each actuation thereby assuring the central location of the notch 8 in the bag making machine.

When the timer circuit 91 times out, the output of timer 73 goes high and conditions the NAND gate 82 to transmit the signal 81. Circuit 71 now continues to transmit pulses 81 for actuating of the notching unit 10 and simultaneously resetting of the counter 67 prior to the reaching of a coincident point.

An identical action is established and created upon shut-down with the output of the timing circuit 91 generating signal 94 for a corresponding period of time. As the machine slows down, the output of the encoder 61 again provides the repetitive count to actuate the controller 62 and thereby the notching unit 10 to maintain appropriate forming of notches 8 in web 9 and completion of bag 3.

The present invention provides an effective and reliable control for maintaining optimum operation of the bag notching unit in a bag drop for a machine.

Various modes of carrying out the invention are contemplated as being within the scope of the following claims particularly pointing out and distinctly claiming the subject matter which is regarded as the invention.

We claim:

1. An edge notching control apparatus for actuating a rotating cutting head having a cutting member secured to an outer portion of the head for removing an edge material and forming a notch in a continuously moving web, comprising an indexing motor connected by a direct drive to said rotating head and providing for time spaced rotation of said cutting head, a controller connected to energize said indexing motor to gradually accelerate said cutting member to provide an essentially maximum velocity as the cutting member moves through the web and then to gradually decelerate said motor to a reference state, a bag making machine operating in continuous sequential bag making cycles for severing said web to form a series of corresponding bags with said notches located intermediate the width of the bag, drive means for moving said web through said bag making machine, a signal generator coupled to said bag making machine and generating a first control signal for each bag making cycle, said control signal being created in phased relation to the length of the bag moving through said cutting head to locate said notch in the same location in said bag making machine, web supply means to supply said web to said cutting head at a selected tension and varying the length of material passing through said cutting head to maintain said tension, signal means coupled to the web for generating a second control signal in accordance with the actual length of web passing said cutting head, said web supply means and said bag making machine having periods in which the speed of moving said web is correspondingly changed, logic circuit means connected to transmit said first and second control signals to said control for actuating said indexing motor, and timing means connected to said logic circuit means and actuated during said periods to operably disable said first control signal and transmit said second control signal.

2. The control apparatus of claim 1 including means to operably disable said signal means and connected to respond to said first control signal.

3. The control apparatus of claim 1 wherein the controller is a programmable controller.

4. The control apparatus of claim 1 wherein said bag making machine includes a main control shaft and said first signal generator is coupled to said shaft, said signal means including a rotary encoder including driven means coupled to said web and generating a pulse train signal including a constant number of pulses each revolution, a counter connected to receive said second control signal in response to a count equal to the length of web between said notches.

5. The control apparatus of claim 4 wherein said logic circuit means includes a first control signal circuit connected to said signal generator and transmitting a logic signal for each control signal, a first logic gate connected in said first control signal circuit to transmit said logic signal, said timing means being connected to said first logic gate, a second control signal circuit connected to said counter, a second logic gate connected to said first logic gate and to said second control signal circuit for transmitting said first and second control signals, and a reset signal circuit connected to said first logic gate and to said counter to reset said counter in response to the signal from said first logic gate.

6. The control apparatus of claim 1 including a start and stop means for starting said web supply means and said bag making machine and for stopping thereof, said web supply means and said bag making machine gradually increasing the web speed during starting and gradually decreasing the web speed during stopping, and a movable tension control means coupled to the web to vary the web from said supply means during said starting and stopping to maintain a constant web tension, and wherein said timing means includes an electronic timing circuit, input means connected to said start and stop means and establishing a signal to said timing means in response to a start signal and in response to a stop signal to operably disable said first control signal.

7. In notched web forming apparatus having a notching means for cutting equispaced notches in a continuously moving web with the speed of said web moving past said notching means changing during selected periods of web travel, the improvement in a drive unit for said notching means, comprising a control adapted to actuate said notching means to notch said web, a main drive signal source for actuating said control during periods other than said selected periods to establish said equispaced notches, a selected period drive signal source for actuating said control during said selected periods, said selected period drive signal source including means to determine the actual length of web moving through said notching means and actuating said notching means to establish said equispaced notches, and interlock means establishing control signals at the start and end of any selected period, said interlock means operating to disable said main drive signal source and enable said selected period drive signal source during said selected periods.

8. The notched web forming apparatus of claim 7 wherein a web drive means is coupled to move said web with a continuous and uninterrupted movement at a selected web speed and including a web take-up means for maintaining a constant tension in said web and whereby said web length passing through said cutting means in a given time period being constant, said web movement being accelerated to and decelerated from said selected web speed during start up and shut down of the bag forming apparatus and establishing said selected periods.

9. The notched web forming apparatus of claim 8 including status means connected to detect start up and shut down of the bag forming apparatus and connected to operably disable the main signal source and operably enable the selected signal source during the start up and shut down of the bag forming apparatus.

10. The notched web forming apparatus of claim 7 wherein said notching means includes a high speed cutting means and a stepper motor connected to rotate said cutter means to cut said notch.

11. A draw tape bag forming apparatus for forming draw tape bags from a web moving continuously through a plurality of hem forming and tape inserting devices, comprising a notching apparatus for forming equispaced notches in the web hem with said notches located centrally of the bag sidewalls, comprising a high speed cutting means including a motor means operable to cut a notch in the web hem, a programmable control unit for energizing said motor means in response to a control signal, a web drive means coupled to move said web with a continuous and uninterrupted movement at a selected web speed and including a web take-up means for maintaining a constant tension in said web and whereby said web length passing through said cutting means in a given time period being constant, said web movement being accelerated to and decelerated from said selected web speed during start up and shut down of the bag forming apparatus, main signal means coupled to said web drive means for actuating said programmable control unit in time spaced sequence to create said equispaced notches, second signal means coupled to said web for actuating said programmable control unit in accordance with the length of web passing through said cutting means, and status means connected to detect start up and shut down of the bag forming apparatus and connected to operably disable the main signal means and operably enable the second signal means during the start up and shut down of the bag forming apparatus.

12. The apparatus of claim 11 wherein said motor means is a stepper motor, said programmable control unit establishing a smooth acceleration and deceleration of said cutting means in response to a first and second control signals.

13. The apparatus of claim 12 including a logic circuit means for selectively transmitting said first and second control signals, and said second signal means including means to generate a count signal proportional to the web movement and a resettable counter to generate said second control signal, said first control signal being operable to reset said counter.

* * * * *